United States Patent [19]

E'nama et al.

[11] Patent Number: 5,064,988

[45] Date of Patent: Nov. 12, 1991

[54] LASER LIGHT ATTACHMENT FOR FIREARMS

[75] Inventors: David J. E'nama, Willow Grove, Pa.; Thomas A. Pertierra, Orlando, Fla.

[73] Assignee: Havis-Shields Equipment Corporation, Warminster, Pa.

[21] Appl. No.: 512,142

[22] Filed: Apr. 19, 1990

[51] Int. Cl.[5] ..... B23K 26/00

[52] U.S. Cl. ..... 219/121.6; 42/103

[58] Field of Search ..... 219/121.6, 121.85; 42/103

[56] References Cited

U.S. PATENT DOCUMENTS 4,212,109 7/1980 Snyder ..... 33/241

*Primary Examiner*—C. L. Albritton

*Attorney, Agent, or Firm*—Zachary T. Wobensmith, III

[57] ABSTRACT

A laser light attachment for firearms and the like is disclosed. The attachment includes a housing for mounting to the handguard of a firearm, and contains batteries and a light source which may be visible or infrared, and contain one or more lasers of the visible or infrared spectrum type with windage and elevation adjustments, and with switches to control the operation of the light and the lasers.

6 Claims, 4 Drawing Sheets

LASER LIGHT ATTACHMENT FOR FIREARMS

BACKGROUND OF THE INVENTION

1. Field of the Invention

This invention relates to a laser light attachment for a firearm and more particularly to a self-contained lighting system and laser aiming device for mounting to the handguard of a rifle, or other firearm.

2. Description of the Prior Art

The use of lasers in connection with aiming firearms has grown considerably in recent times and improved devices are much in demand. It is known in the art to separately mount a flashlight to a firearm for illumination, and also to separately mount a laser for target acquisition. The lasers and the flashlights are mounted independently of each other, and most of them are of the type which emit light in the visible range.

For many purposes, particularly nighttime surviellance and clandestine operations it is desirable to have infrared capability for both the light and lasers as well as a visible light capability. Firearms with infrared capability may have a scope mounted thereon which allows the user to detect infrared light emissions of the user may wear infrared sensitive goggles. The laser light attachment of the invention is self-contained, can be mounted to virtually any firearm, provides both visible and infrared light for illumination, and visible and infrared lasers for target acquisition.

SUMMARY OF THE INVENTION

The invention provides a laser light attachment for firearms. More particularly the disclosed embodiment of the invention provides a housing which has a light source at the bottom, which can emit light in the visible or infrared spectrums, with at least one laser mounted in the housing above the light source, for aiming and target acquisition, the laser may be capable of operating in the visible or invisible infrared spectrum and may have windage and elevation adjustment capabilities. The attachment is self-contained, with switches to control the operation of the light source and the laser.

The principal object of the invention is to provide an attachment for firearms that mounts both a light and at least one laser in the same attachment.

A further object of the invention is to provide a laser light attachment that provides light and laser emissions in either the visible or infrared spectrums.

A further object of the invention is to provide a laser light attachment that is self-contained.

A further object of the invention is to provide a laser light attachment that can be mounted to virtually any firearm.

A further object of the invention is to provide a laser light attachment that is easy to use and enjoys a long service life.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

It should, of course, be understood that the description and drawings herein are illustrative merely and that various modifications and changes can be made in the structure disclosed without departing from the spirit of the invention.

DESCRIPTION OF THE PREFERRED EMBODIMENTS

Figure 1:
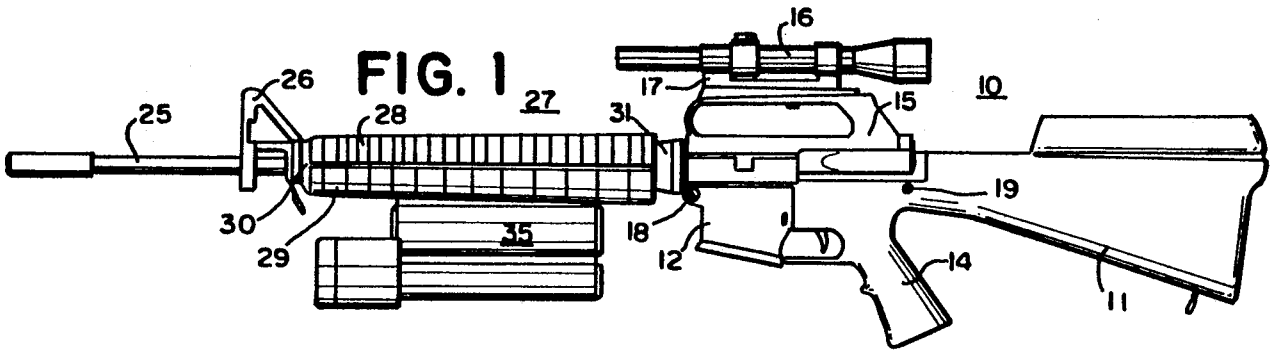
FIG. 1 is a side elevational view of one embodiment of the laser light attachment of the invention mounted to a firearm.
Figure 2:
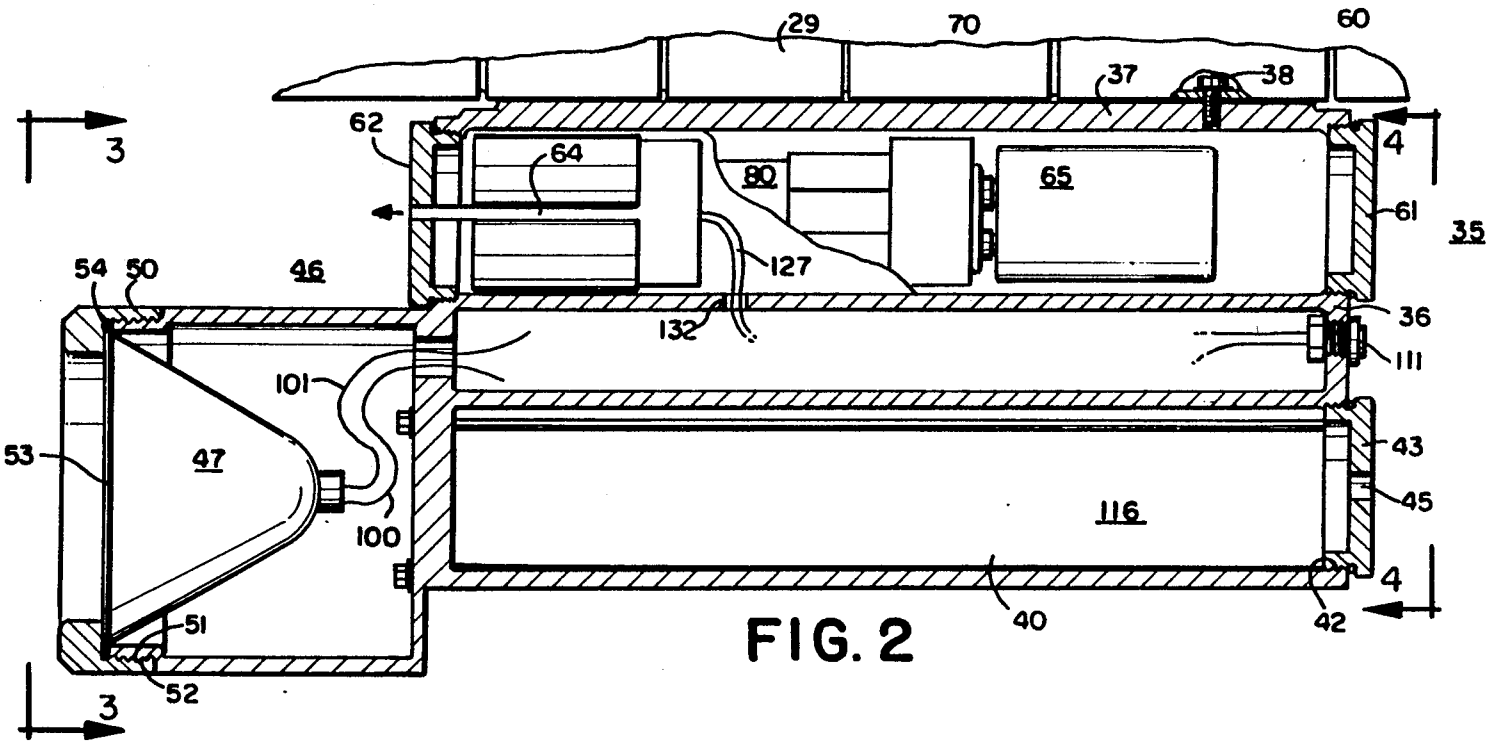
FIG. 2 is a side elevational view enlarged of the laser light attachment of FIG. 1, partially broken away to show the interior details.
Figure 3:
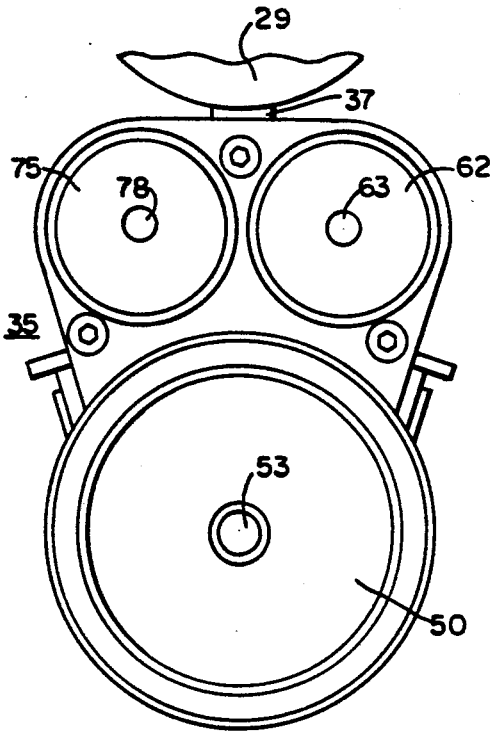
FIG. 3 is a vertical sectional view taken approximately on the line 3—3 of FIG. 2.
Figure 4:
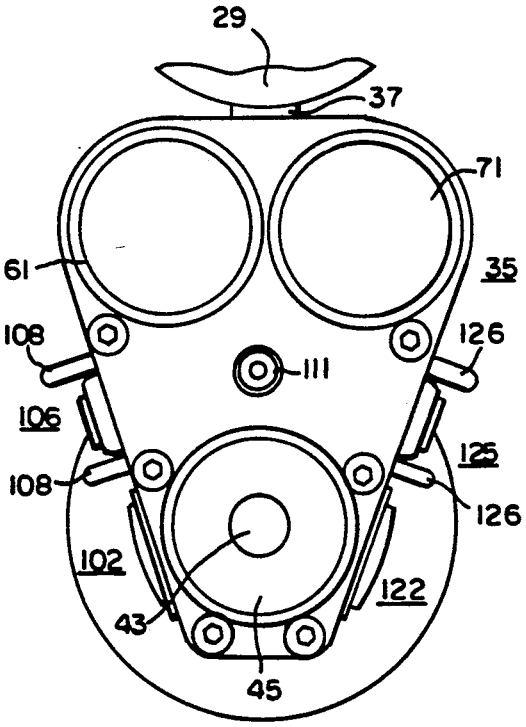
FIG. 4 is a vertical sectional view taken approximately on the line 4—4 of FIG. 2.
Figure 9:
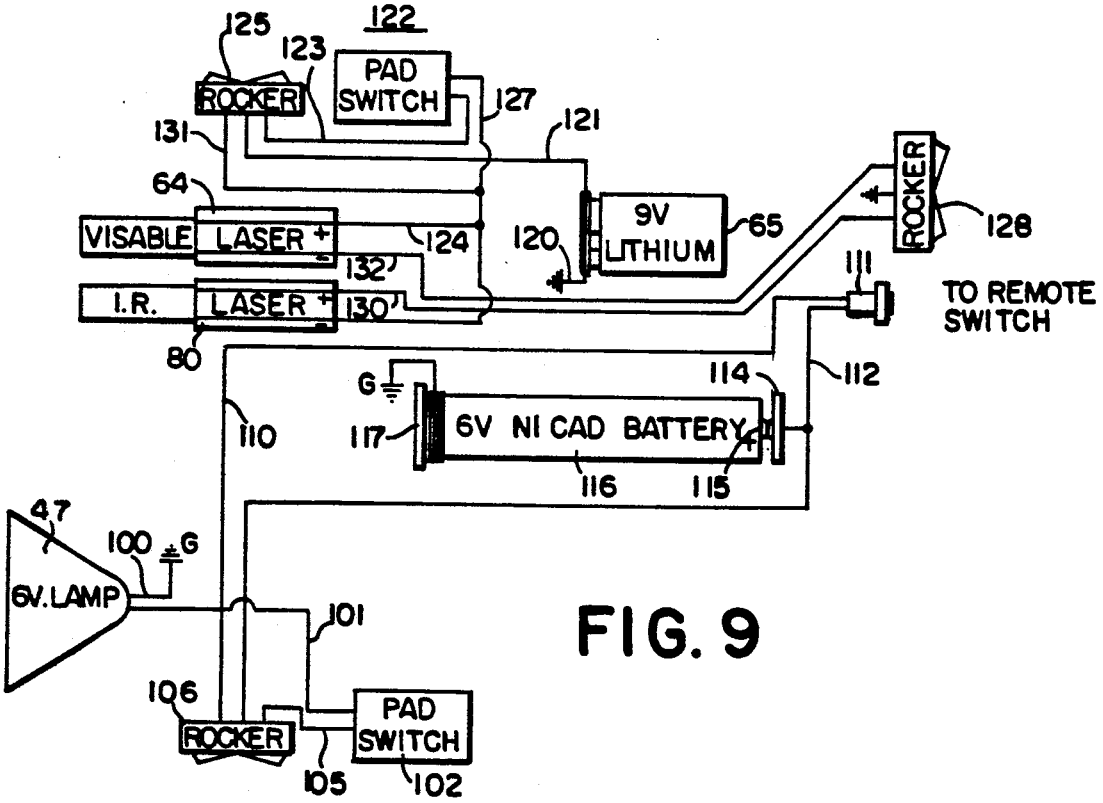
FIG. 9 is a diagrammatic view of the electrical circuitry used with the embodiment of laser light attachment of FIG. 1.

Referring now more particularly to the drawings and particularly to FIGS. 1 and 4, and 9, in FIG. 1 a firearm 10 is illustrated which is of the AR-15 series as manfactured by Colt Firearms, Division of Colt Industries, Hartford, Conn. The firearm 10 has a stock 11, lower receiver 12, pistol grip 14, upper receiver 15, and telescopic sight 16, mounted to the upper receiver 15 by mount 17. The sight 16 may have infrared detection capability. Both the scope 16 and mount 17 are well known in the art and available from a multiplicity of sources.

The upper receiver 15 is mounted to the lower receiver 12 by bolt 18 and pin 19 in well known manner. The upper receiver 15 has a barrel 25, with a front sight 26, and a two piece forearm or handguard 27. The handguard has upper and lower halves 28 and 29 and is retained around barrel 25 by engagement in a fixed collar 30 attached to the front sight 26, and a spring urged rear collar 31 as shown in front and rear views 3 and 4. The laser light attachment 35 has a housing 36 and a rib 37 on the top thereof with a plurality of screws 38 therein, detachably securing it to the lower half 29 of handguard 27.

The housing 36 can be manufactured of any suitable material with anodized aluminum being particularly suitable.

The housing 36 which is of one piece construction has a lower hollow tubular compartment 40 open at the ends, with internal threads 42 and is closed off by a cap 43 at the rear which retains a laser lens 45, which is a spare (eye safe) lens. The compartment 40 depending on the configuration desired, which can be one or two lasers, can be used as a spare battery compartment or as a main battery compartment carrying a 9 volt nickel cadmium battery therein of well known type. A light source 46 is provided in front of compartment 40 in extension 49, and includes a light bulb and reflector assembly 47 which is carried in a cap 50. The cap 50 has threads 51 engaged with threads 52 on extension 49. The cap 50 also has a lens 53 and a perimeteral O-ring 54 for water proofing. An optional lens (not shown) can be provided to convert the emitted light to the infrared spectrum. Above compartment 40 another hollow tubular compartment 60 is provided, which can be used as a battery compartment, but in the embodiment illustrated is used as a visible laser containing compartment to be described. Compartment 60 is open at the ends and closed off at the rear as shown in FIG. 4 by a threaded cap 61. Inside compartment 60 a visible laser unit 64 is provided, having a lens 63, of well known type, of various milliwatt rating and available from Toshiba, Tokyo, Japan. The laser unit 64 is provided with externally accessible windage and elevation adjustment controls (not shown) which can be accessed by removing caps 66 and 67 in well known manner.

A battery 65 is provided for energization of unit 64, which in this embodiment is a 9 volt lithium battery of well known type.

An additional hollow tubular compartment 70 is provided, side by side with compartment 60, open at both ends and closed off at the rear as seen in FIG. 4 by a cap 71. The compartment 70 carries a laser unit 80 which has a clear laser lens 78 and which is an infrared laser dot emitter of well known type, also available from Toshiba, Tokyo, Japan. The laser unit 80 can also be of various milliwatt rating.

The laser unit 80 is provided with externally accessible windage and elevation adjustment controls (not shown) which can be accessed by removing caps 75 and 76 in well known manner. The battery 65 is also available for energization of laser unit 80 to be described.

Referring now additionally to FIG. 9 the wiring diagrams associated with attachment 10 are illustrated. The light source with bulb and reflector assembly 47 has wire 100 connected thereto and to ground G. Another wire 101 is connected thereto and to one side of a pressure or pad switch 102 which is carried on housing 36 for contact by the user (not shown). The other side of switch 102 has a wire 105 connected it to a three position rocker switch 106, carried on housing 46 as shown in FIG. 4, and which can be protected from accidental contact by raised ribs 108. The switch 106 has a wire 110 connecting it to one side of a plug 111 carried in housing 46 as shown in FIG. 4. Plug 111 can be connected to a remote switch (not shown) or to a source of electrical energy for battery recharging. The plug 111 is connected by wire 112 to a contact 114 which engages the positive terminal 115 of a battery 116, in compartment 40 of housing 46. The battery 116 is of six volt capacity and of any well known type, rechargeable or non rechargeable as desired. The other or negative terminal 117 of battery 116 is connected to ground G.

The wire 112 also extends from contact 114 to rocker switch 106.

The circuitry for the laser units 64 and 80 includes the nine volt battery 65, which is connected to ground G by wire 120, and by wire 121 to a three position rocker switch 125 mounted in housing 46 and protected from accidental contact by ribs 126. Switch 125 has a wire 123 connecting it to a pressure or pad switch 122 carried in housing 46. Switch 125 has another wire 131 connecting it to a wire 127.

The switch 122 has the wire 127 connected thereto and to laser unit 80, with an additional wire 130 connected to unit 80 and to three position rocker switch 128 which is also connected to ground G. Laser unit 64 has a wire 132 connected thereto and to rocker switch 128. Laser 64 has an additional wire 124 connected to wire 127.

Figure 5:
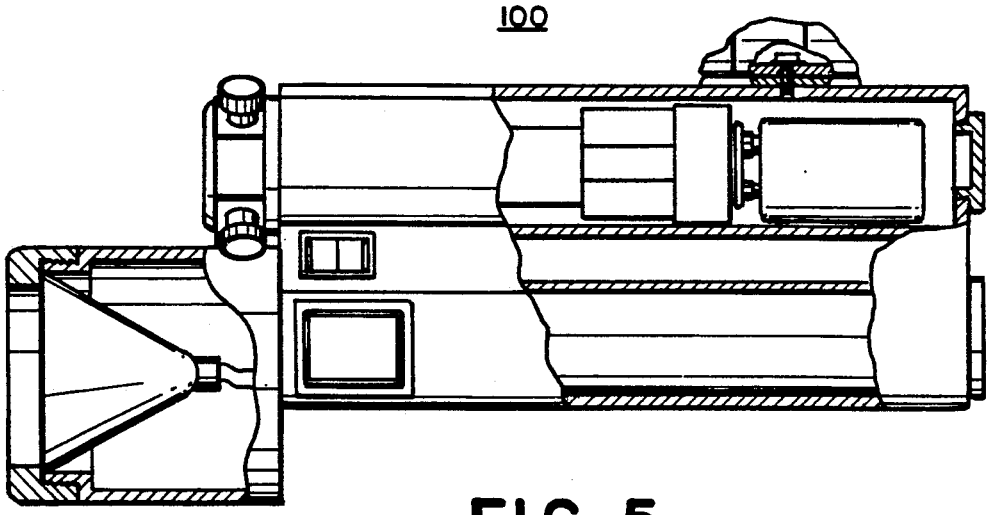
FIG. 5 is a side elevational view of another embodiment of laser light attachment.
Figure 6:
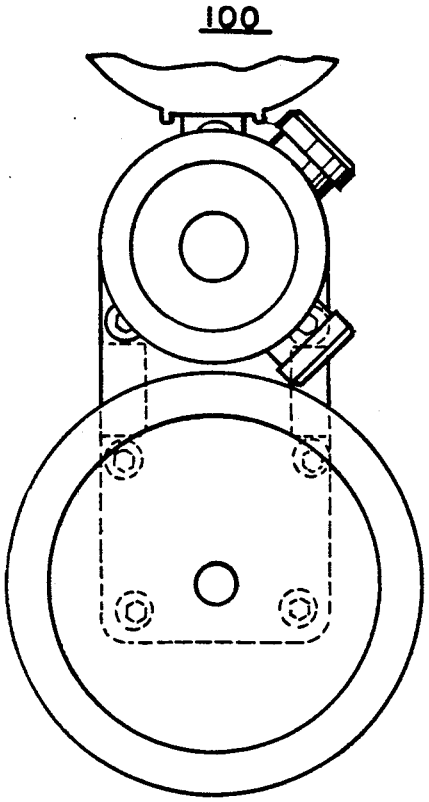
FIG. 6 is a front elevational view of the laser light attachment of FIG. 5.
Figure 10:
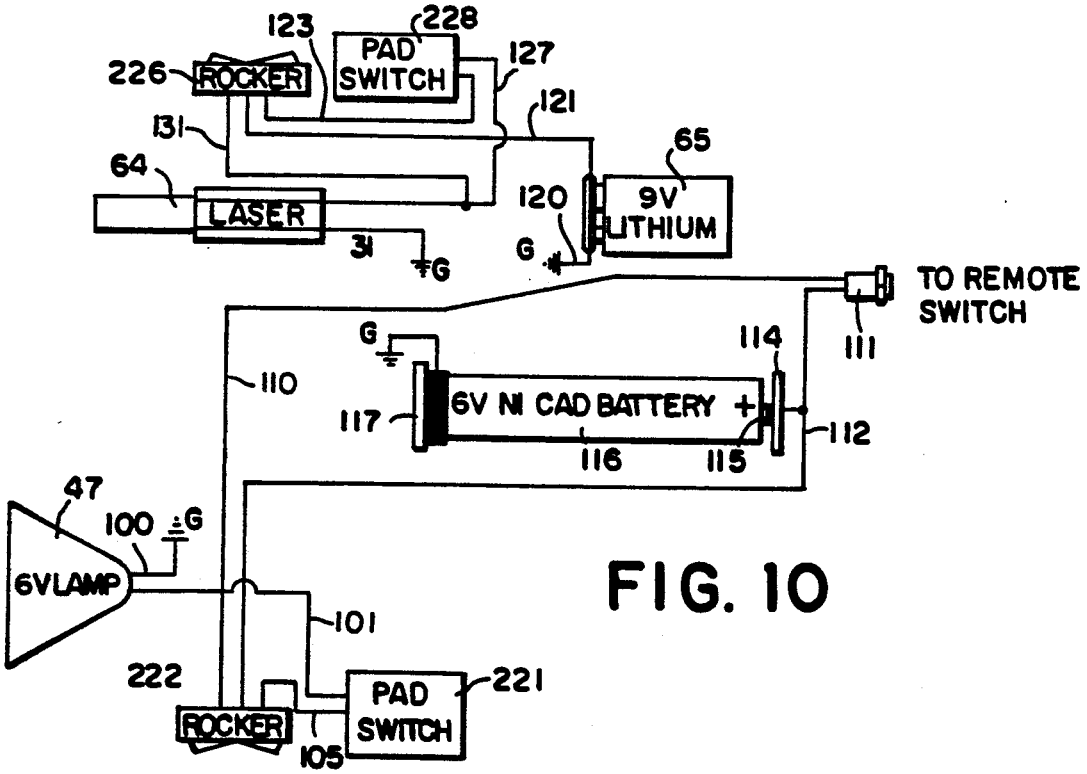
FIG. 10 is a diagrammatic view of the electrical circuitry used with the embodiment of the laser light attachment of FIG. 5.

Referring now more particularly to FIGS. 5, 6 and 10, another embodiment of laser light attachment 200 is therein illustrated. The laser light attachment 200 is of the over and under type with an outer housing 201 of one piece construction, preferably of anodized aluminum and mounted to firearm 10 as described for attachment 35. The housing 201 has a lower tubular compartment 202 which is open at the ends, with internal threads 203 and is closed off by a cap 204 at the rear which retains a laser lens 205, which is a spare (eye safe) lens. The compartment 202 is a battery compartment and has a battery 116 therein as described. A light source 46 is provided in front of compartment 202 in extension 209, and includes a light bulb and reflector assembly 47 which is carried in a cap 210. The cap 210 has threads 211 engaged with threads on extension 209. The cap 210 also has a lens 212 and a perimeteral O-ring 214 for water proofing. An optional lens (not shown) can also be provided to convert the emitted light to the infrared spectrum. Above compartment 202 another hollow tubular compartment 220 is provided, which is a laser containing compartment to be described. Compartment 202 is open at the ends and closed at the rear as shown in FIG. 5 by a threaded cap 221. Inside compartment 220 a laser unit **64*a* having a lens 65 is provided, of well known type, of various milliwatt rating and available from Toshiba, Tokyo, Japan. The laser unit 64*a* is of the visible or of the infrared dot emitting type and can be removed and either type installed in compartment 220 as determined by the user. The laser unit 64*a* is also provided with externally accessible windage and elevation adjustment controls (not shown) which can be accessed by removing caps 66*a* and 67*a* in well known manner. The unit 64 has a battery 65** which in this embodiment is a 9 volt lithium battery of well known type.

Referring now additionally to FIG. 10 the wiring diagram associated with attachment 200 is illustrated. The light source with bulb and reflector assembly 47 has wire 100 connected thereto and ground G. Another wire 101 is connected thereto and to one side of a pressure or pad switch 221 which is carried on housing 200 for contact by the user (not shown). The other side of switch 221 has a wire 105 connecting it to a three position rocker switch 222 carried on housing 200, and which can be protected from accidental contact by raised ribs 225. The switch 222 has a wire 110 connecting it to one side of a plug 111 carried in housing 200. Plug 111 can be connected to a remote switch (not shown) or to a source of electrical energy for battery recharging. The plug 111 is connected by wire 112 to a contact 114 which engages the housing 46. The battery 116 is of six volt capacity and of any well known type, rechargeable or non-rechargeable as desired. The other or negative terminal 117 of battery 116 is connected to ground G.

The wire 112 also extends from contact 114 to rocker switch 222.

The circuitry for the laser unit **64*a* includes the nine volt battery 65, which is connected to ground G by wire 120, and by wire 121 to a three positioin rocker switch 226 mounted in housing 46 and protected from accidental contact by ribs 227. Switch 226 has a wire 123 connecting it to a pressure or pad switch 228 carried in housing 46. Switch 226 has another wire 131 connecting it to a wire 127, which is connected to laser unit 64***a*.

Figure 8:
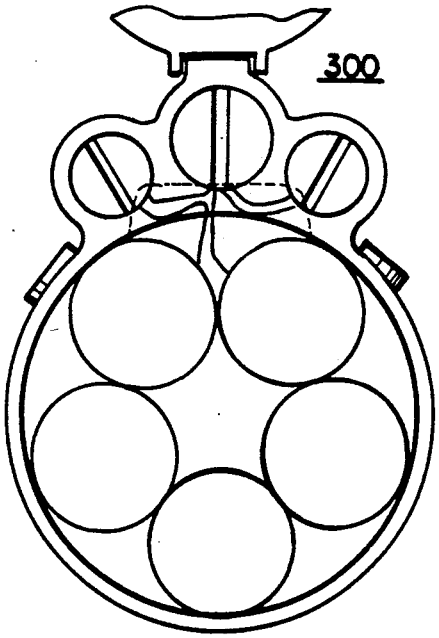
FIG. 8 is a rear elevational view, partially broken away, of the laser light attachment of FIG. 7.
Figure 7:
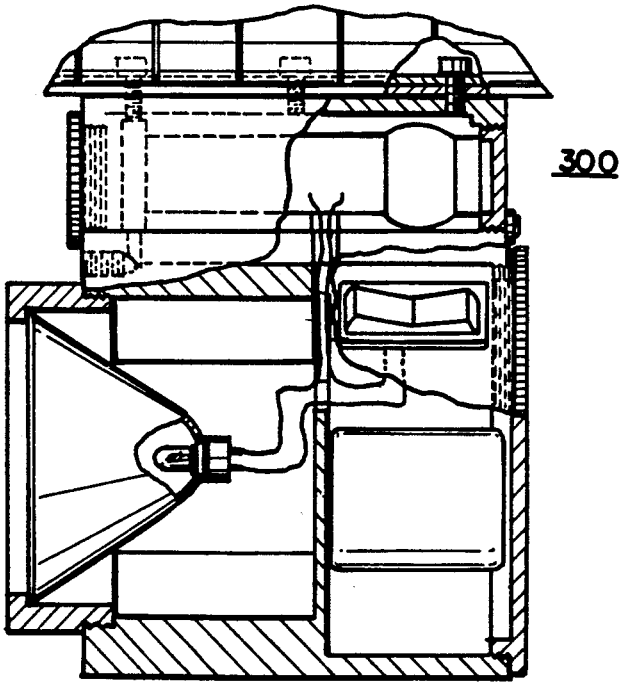
FIG. 7 is a side elevational view partially broken away of still another embodiment of laser light attachment.

Referring now additionally to FIGS. 7 and 8 another embodiment of laser light attachment 300 is therein illustrated.

The laser light attachment 300 has a housing 301 as shown in side and rear views 7 and 8, and a rib 302 on the top thereof to secure it to the handguard of a firearm (not shown).

The housing 300 can be manufactured of any suitable material with anodized aluminum being particularly suitable.

The housing 300 is similar to housings 35 and 200 but considerably shorter and more compact. The housing 300 is of one piece construction, with lower hollow tubular rear compartment 303, open at the rear end 304, and closed off by a cap 305 at the rear 304.

A replaceable battery pack 310 is provided in compartment 303 which as illustrated contains 5 cells, and can be of any well known type to provide 6 volts for light energization to be described.

The housing 300 has a front lower compartment 312 which has a light source 46 therein, which includes a light bulb and reflector assembly 47 which is carried in a cap 314. The cap 314 has threads 315 engaged with threads 316A in compartment 312. The cap 314 has a lens 315 and a perimeteral O-ring 316 for water proofing. An optional lens (not shown) can also be provided to convert the emitted light to the infrared spectrum. Above compartments 303 and 312 another hollow tubular compartment 320 is provided, which in the embodiment illustrated is used as a laser containing compartment to be described. Compartment 320 is open at the ends and closed off at the rear as shown in FIG. 8 by a threaded cap 321. Inside compartment 320 a laser unit 64*b* is provided having a lens 65*b* of well known type, of various milliwatt rating and available from Toshiba, Tokyo, Japan. The laser unit 64*b* can be of the visible spectrum, or a dot emtting laser in the infrared spectrum and is provided with externally accessible windage and elevation adjustment controls (not shown) which can be accessed by removing caps 66*b* and 67*b* in well known manner. A battery compartment 325 is provided adjacent to compartment 320 and which contains a battery 65 of well known type which can be a 9 volt lithium battery.

An additional hollow tubular compartment 326 is provided, on the other side of compartment 320, open at both ends and closed off at the rear as seen in FIG. 8 by a threaded cap 327. Compartment 326 can contain wiring for the laser unit 64*b* or can be used as a spare battery compartment as required. Laser light attachment 300 can be wired up as described for attachment 200, with the same switches and other features.

While firearm 10 has been illustrated for the described attachments 35, 200 and 300, with a scope 16 which may have infrared detection capability, goggles of well known type sensitive to infrared light can be worn by the user (not shown).

The mode of operation is apparent from the foregoing description.

It is thus apparent that a laser light attachment has been provided with which the objects of the invention are achieved.

We claim:

1. A laser light attachment for firearms which comprises a housing for attachment to said firearm, at least two compartments in said housing, a light source in said housing, at least one laser unit in one of said compartments, said laser unit having internally contained and externally accessible windage and elevation adjustment means, electrical energy means in said housing, circuitry means connecting said light source, said laser units and said electrical means, and switch means connected to said circuitry means to activate said light and/or at least one of said laser units.

2. An attachment as defined in claim 1 in which said light source emits light in the infrared spectrum.

3. An attachment as defined in claim 1 in which at least one of said laser units is an infrared dot emitting laser.

4. An attachment as defined in claim 1 in which said switch means includes at least one three position rocker switch, and a momentary contact switch.

5. An attachment as defined in claim 1 in which said laser unit is mounted above said light source.

6. An attachment as defined in claim 1 in which two laser units are provided in side by side configuration above said light source.

* * * * *